US005186131A

United States Patent [19]

Shinozawa et al.

[11] Patent Number: 5,186,131

[45] Date of Patent: Feb. 16, 1993

[54] DISTRIBUTOR

[75] Inventors: Toshiyuki Shinozawa; Hiroyuki Fujita; Hideaki Arai, all of Saitama, Japan

[73] Assignees: Toyo Denso Kabushiki Kaisha; Honda Giken Kogyo Kabushiki Kaisha, both of Tokyo, Japan

[21] Appl. No.: 755,611

[22] Filed: Sep. 5, 1991

[30] Foreign Application Priority Data

Sep. 5, 1990 [JP] Japan ..... 2-93347[U]

[51] Int. Cl.[5] ..... F02P 1/00

[52] U.S. Cl. ..... 123/146.5 A; 200/306

[58] Field of Search ..... 123/146.5 A; 200/19 R, 200/19 DR, 19 DC, 306

[56] References Cited

U.S. PATENT DOCUMENTS

| | | | |
|---|---|---|---|
| 3,577,970 | 5/1971 | King et al. | 123/146.5 A |
| 3,789,168 | 1/1974 | Meyer et al. | 123/146.5 A |
| 4,023,546 | 5/1977 | Kawakami | 123/146.5 A |
| 4,281,627 | 8/1981 | Sakurai . | |
| 4,348,993 | 9/1982 | Ueno et al. . | |
| 4,627,393 | 12/1986 | Takenaka | 123/146.5 A |
| 4,639,560 | 1/1987 | Kronberger . | |
| 4,661,661 | 4/1987 | Kronberger . | |
| 4,793,298 | 12/1988 | Arano et al. . | |
| 4,903,673 | 2/1990 | Chiba et al. | 123/146.5 A |

FOREIGN PATENT DOCUMENTS

| | | |
|---|---|---|
| 57-164260 | 10/1982 | Japan . |
| 59-16533 | 5/1984 | Japan . |
| 60-21504 | 6/1985 | Japan . |
| 63-71578 | 3/1988 | Japan . |
| 64-46477 | 3/1989 | Japan . |
| 1-100381 | 4/1989 | Japan . |
| 1-203660 | 8/1989 | Japan . |

*Primary Examiner*—Noah P. Kamen

[57] ABSTRACT

A distributor for a vehicle includes a housing and a cap operatively positioned on the housing for defining a closed space therebetween. A central electrode and a side electrode are operatively mounted within the cap in a predetermined disposition. A distributor rotor is rotatably mounted relative to the housing and projects within the closed space, the distributor rotor includes an upper end and a lower end. At least one fin is mounted adjacent to the upper end of the distributor rotor for rotation together with the distributor rotor. An air flow guiding member projects into the closed space. An air intake aperture is provided for introducing ambient air into the closed space. A discharge aperture is formed in the cap for discharging swirling air flow induced by rotation of the distributor rotor to travel from the air intake aperture along the air flow guiding member and through the discharge aperture to the atmosphere. The discharge aperture is formed in the cap at a position above the distributor rotor and the air intake aperture is formed in the cap or the housing at a position in a lower portion of the cap or the housing for enabling acidic material generated by a spark to be discharged through the discharge aperture by the swirling air flow.

3 Claims, 3 Drawing Sheets

DISTRIBUTOR

BACKGROUND OF THE INVENTION

1. Field of the Invention

The invention relates to a distributor having an excellent ventilation efficiency for use in automobile engines and the like.

2. Description of Background Art

Acidic substances such as ozone ($O_3$), etc., produced by a spark discharge that occurs between a distributor rotor mounted on a rotating rotor shaft and a side electrode provided on the side of a cap should be discharged from the distributor. As disclosed in Japanese Laid-Open Patent Application No. 1-100381, for example, a distributor includes a cap having a discharge hole and an inlet hole formed in the top thereof. The cap also includes a wind shielding plate airflow guiding member formed on the inner surface thereof near the opening of the discharge hole. The wind shielding plate projects rearwardly of the latter relative to the rotational direction of the distributor rotor. The arrangement provides for ventilation of the distributor by a pumping action between the discharge hole and the inlet hole utilizing a swirling air flow induced by the rotation of the distributor rotor having blades formed on the upper surface thereof.

SUMMARY AND OBJECTS OF THE INVENTION

In the case of the above-mentioned arrangement, the air flow suction and discharge for ventilation is provided above the distributor rotor. In view of the fact that the acidic substance is heavier than air, there is a possibility that a portion of the acidic substance may flow downwardly into the lower portion of the cap. If this occurs, the acidic substance stagnates in the bottom of the distributor. It then becomes difficult to move the acidic substance upwardly, rendering it difficult to discharge the acidic substance to the atmosphere.

It is an object of the present invention to prevent the occurrence of such a situation.

Further, with respect to the axial direction of the rotor shaft, the side of the cap is referred to as an "upper side" while the side of the housing is referred to as "lower side" hereinbelow.

In the present invention, the above-mentioned problem is obviated by providing a discharge hole which is formed in the cap at a position above the distributor rotor. The inlet hole or air intake is formed at a position below the distributor rotor. In this case, the air intake may be provided either in the cap or in the housing.

Further, an auxiliary airflow guiding member is connected integrally with the airflow guiding member formed in the corner of the cap and extends towards the center of rotation of the distributor rotor. The auxiliary airflow guide member is substantially parallel with the rotational surface thereof and is formed so as to project from the inner surface of the cap into the closed space.

Still further, the distributor rotor includes fins formed on both the upper and lower surface thereof.

Rotation of the distributor rotor having fins on the upper surface thereof induces swirling air flow along the distributor rotor. This swirling air flow is guided by the airflow guiding member into the discharge hole and discharged therefrom together with the acidic substance produced by the spark produced by the distributor rotor to the atmosphere. Since fresh ambient air is drawn into the distributor from under the distributor rotor and flows upwardly, an upward air current is induced within the distributor. Thus, the acidic substance is prevented by the air current from moving downwardly.

The auxiliary airflow guiding member is integrally connected with the airflow guiding member. Thus, the area of the guiding member projecting into the passage for the swirling air flow is increased correspondingly. Moreover, the discharge hole is located in the corner of the cap where the flow speed of the swirling air flow is increased. As a result, a larger quantity of swirling air flow can be introduced easily into the discharge hole, thereby improving the ventilation efficiency.

Still further, because of the provision of additional fins on the lower surface of the distributor rotor, the lower fins cooperate with the fins formed on the upper surface thereof to generate more intense swirling air flow, thus increasing the ventilation efficiency as well.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
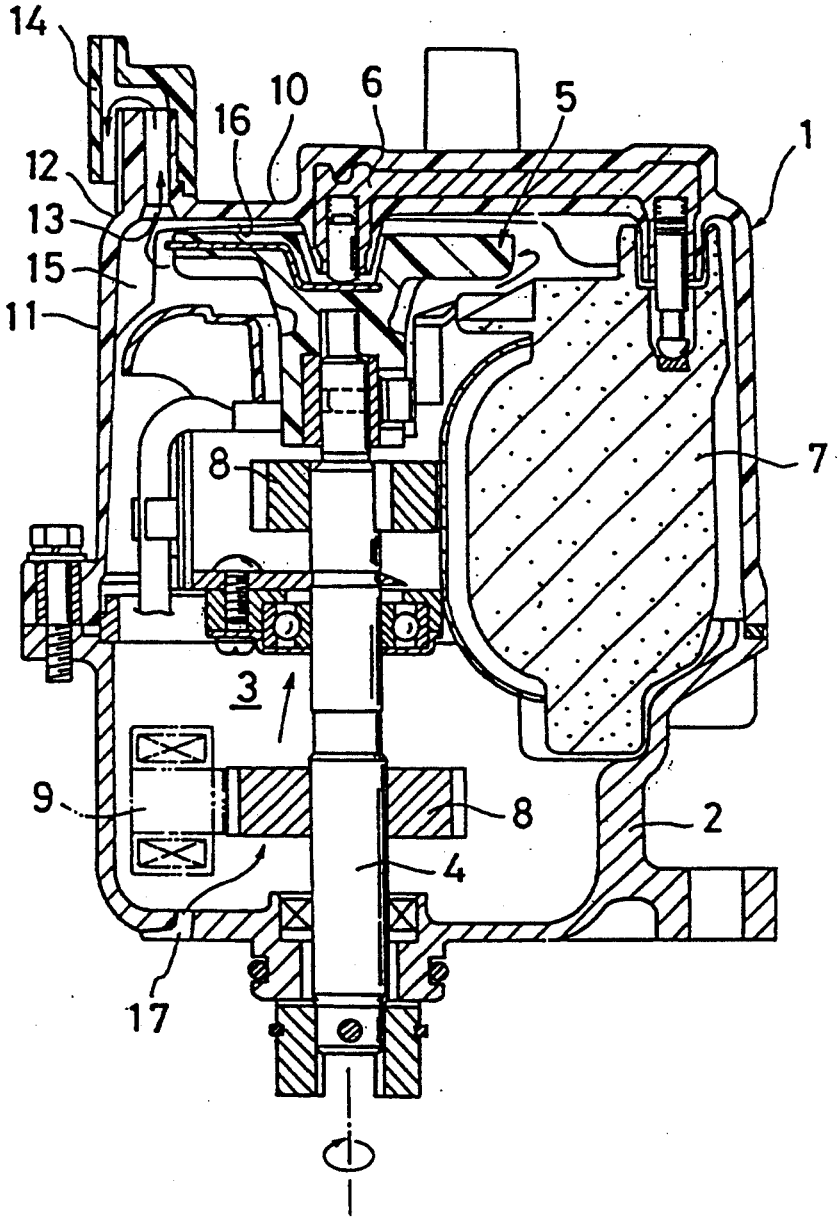
FIG. 1 is an overall sectional view of the distributor.

One embodiment of the present invention is shown in FIGS. 1 to 6. FIG. 1 is an overall sectional view of a distributor for use in automobiles. A cap 1 is mounted on a housing 2 to define a closed space 3 provided by the cap 1 and the housing 2. A rotor shaft 4 is operatively mounted for rotation within the housing 2. A distributor rotor 5 is positioned on the rotor shaft 2. A central electrode 6, an ignition coil 7, a rotor pulser 8, and a pulse generator 9 are operatively mounted relative to the rotor shaft 4.

Two pulser rotors 8 are spaced apart vertically on the rotor shaft 4. The upper pulser rotor 8 is also provided with another pulse generator which is not illustrated in the drawings.

The cap is made of an insulating resin and includes a discharge hole 13 formed in a corner 12 between a top portion 10 and a side surface portion 11 thereof. The discharge hole 13 permits communication between the closed space 3 and the outside air through a ventilating passage 14 of a labyrinth construction. A rib-shaped airflow guiding member 15 and an auxiliary airflow guiding member 16 operatively connected therewith are formed in the corner 12 interior of the cap 1. The airflow guiding member 15 and the auxiliary airflow guiding member 16 form one embodiment of the airflow guiding member 16 according to the present invention. However, in another embodiment only the airflow guiding member 15 may be provided.

The housing 2 is made of a light alloy such as, for example, aluminum or the like, and has an air intake 17 of approximately an L-shape so as to permit communication of the closed space 3 with the atmosphere.

Figure 3:
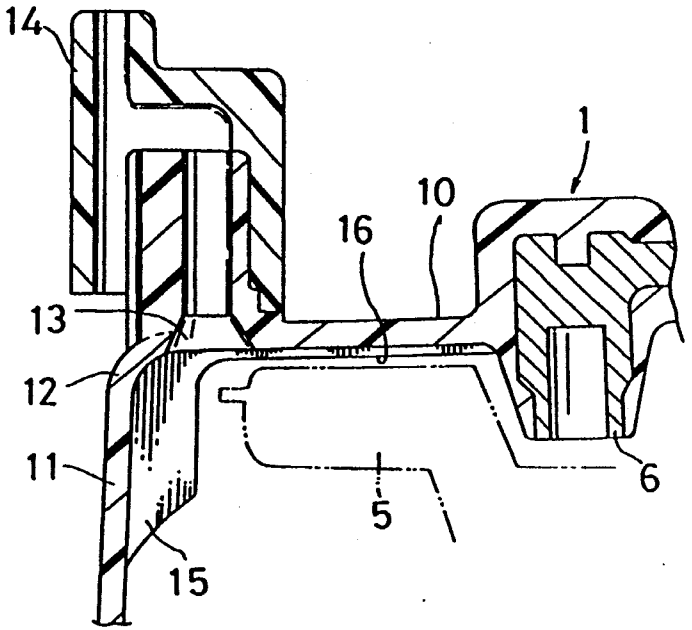
FIG. 3 is an enlarged sectional view of the principal parts.
Figure 2:
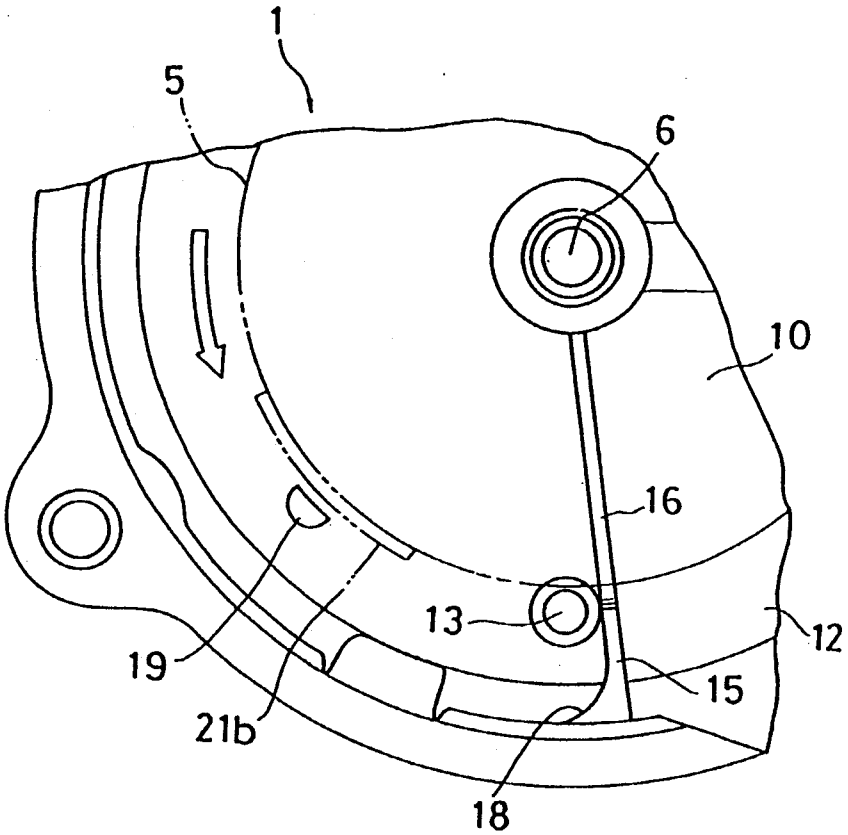
FIG. 2 is a fragmentary view showing the interior of the principal parts of the distributor.
Figure 5:
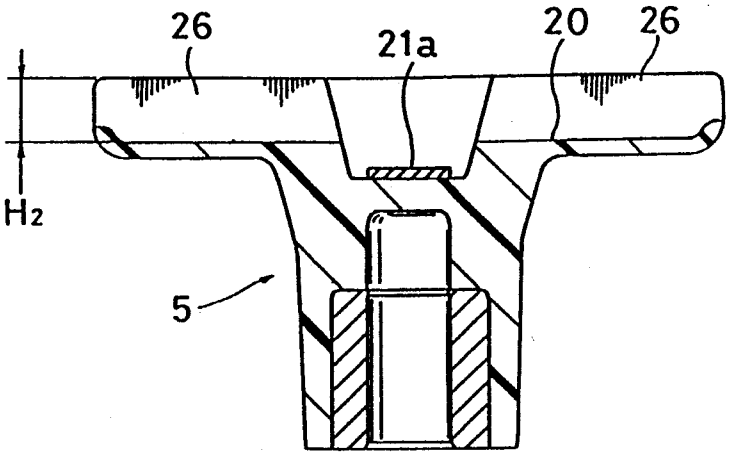
FIG. 5 is a sectional view taken along line V—V in FIG. 4.

FIG. 2 illustrates an enlarged partial view of the interior of the top portion 10 of the cap 1. FIG. 3 is an enlarged view of the portion of the cap which includes the discharge hole 13 shown in FIG. 1. As is obvious from the drawings, the airflow guiding member 15 and the auxiliary airflow guiding member 16 are located in the vicinity of the discharge hole 13. The airflow guiding member 15 and the auxiliary airflow guiding member 16 are located downstream from the discharge hole 13 relative to the rotational direction shown by arrow in FIG. 2 of the distribution rotor 5. The airflow guide 15 and the auxiliary airflow guide 16 project into a passage for swirling the air flow generated by rotation of the distributor rotor 5. The airflow guiding member 15 has a curved surface 18 formed on the front surface side thereof. The auxiliary airflow guiding member 16 is formed along the rotational surface of the distributor rotor 5 and is connected to the airflow guiding member 15 in the vicinity of the central electrode 6. A side electrode 19 is illustrated in FIG. 2.

Figure 6:
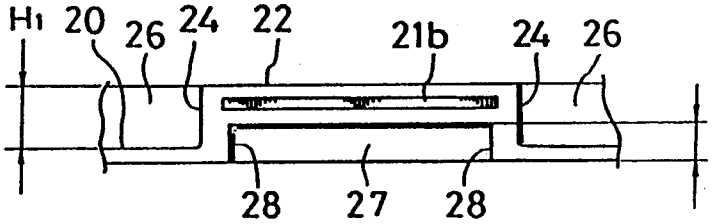
FIG. 6 is a progmentary view looking in the direction shown by arrow VI in FIG. 4.

As shown in FIGS. 1 and 4 to 6, the distributor rotor 5 has a disc-shaped top 20. As illustrated in the top plan view of FIG. 4, a terminal portion 22 is provided wherein a terminal plate 21 is embedded within and extends from the central portion of the rotor 5 to the outer peripheral portion thereof. A weight balancing portion 23 extends from the central portion to the outer peripheral portion in the opposite direction. Both of the terminal portion 22 and the weight balancing portion 23 are formed continuously on the upper surface of the top 20. As illustrated in FIG. 6, the terminal portion 22 is formed so as to be raised by a height $H_1$ from the upper surface of the top 20. The vertical walls of the terminal portion 22 form fins 24. The weight balancing portion 23 is constructed in a manner similar to the terminal portion 22 and includes fins 25 formed on both sides thereof. In addition, the distributor rotor 5 includes fins 26 formed thereon in a direction at right angles to the terminal portion 22 and the weight balancing portion 23. As is apparent from FIG. 5, which is a sectional view taken along line V—V in FIG. 4, the fins 26 form vertical walls, respectively, raised by a height $H_2(\approx H_1)$ from the upper surface of the top. The distribution rotor 5 includes fins 24, 25 and 26 formed substantially in a crosswise direction on the upper surface thereof.

Figure 4:
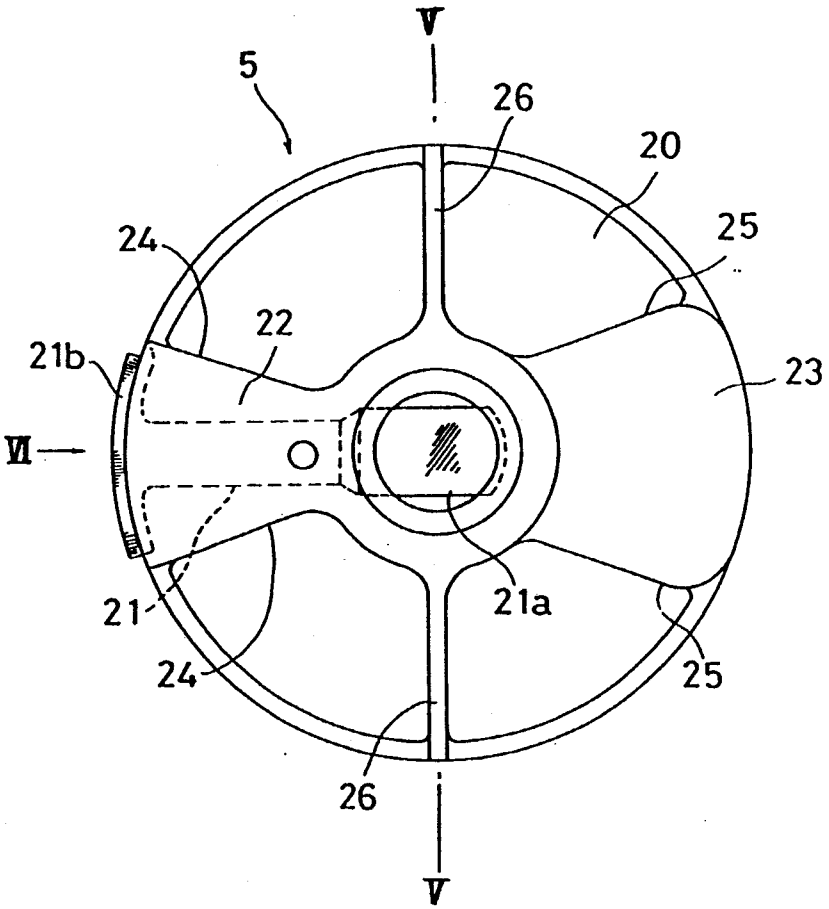
FIG. 4 is a plan view of the principal parts.

Furthermore, as illustrated in FIG. 6, which is a view looking in the direction shown by arrow VI in FIG. 4, the back side of the terminal portion 22 forms an upwardly reentrant, cutout portion or a hollow portion 27. The left and right step thereof forming vertical wall-shaped fins 28 having a height of $H_3$. An inner end 21*a* and an outer end 21*b* are provided on the terminal plate 21. As illustrated in FIG. 2, the outer end 21*b* forms a small gap between the outer end 21*b* and the side electrode 19.

Next, the operation of this embodiment will be described hereinbelow. In FIG. 1, when the rotor shaft 4 and the distributor rotor 5 are rotated as an integral unit with the operation of an engine (not shown), swirling airflow is generated inside the closed space 3 along the distributor rotor 5. This swirling airflow is guided by the airflow guiding member 15 and the auxiliary airflow guiding member 16, which are formed near and on a downstream side of the discharge hole 13 in such a way as to project into the passage for airflow. Thus, air flow passes through the discharge hole 13 and the ventilating passage 14, as illustrated in FIGS. 1 and 3, and exits therefrom to the atmosphere. Since the discharge hole 13 is located in the corner 12 where the peripheral speed of the swirling air flow reaches its maximum value and the airflow guiding member 15 has the curved surface 18 on the front surface side thereof, the air flow can be guided effectively at that time. In addition, because of the provision of the auxiliary airflow guiding member 16 in addition to the airflow guiding member 15, the area of the guiding member projecting into the passage on the downstream side of the discharge hole 13 for discharging the swirling air flow can be increased as much as possible. Thus, an increase in the airflow discharge efficiency is provided.

Further, since the discharge of the swirling air flow induces upward air flow in the closed space 3, fresh air is drawn from the air intake 17 formed in the bottom of the housing 2 into the closed space 3. Thus, the closed space 3 is ventilated with the upwardly flowing fresh air which flows from the air intake 17 towards the discharge hole 13. At the same time, this upwardly flowing fresh air flow will remove any acidic substance produced around the distributor rotor 5 due to spark discharge which occurs between the outer end 21*b* and the side electrode 19. Thus, downwardly flowing acidic substance is prevented from moving downwards in the closed space 3. Even if the acidic substance moves down in the closed space 3, it can be removed upwardly and discharged by the swirling air flow. Therefore, the acidic substance can be discharged to the atmosphere rapidly and securely. It is possible to prevent the acidic substance from stagnating in the lower portion of the closed space 3. As a result, adverse effect of the acidic substance to component parts such as the pulse generators 9 mounted in the closed space 3 can be avoided. This results in an improved durability of the component parts. Further, the downward movement of the acidic substance is inhibited to some degree by the disc-like configuration of the top 20 of the distributor rotor 5.

Moreover, since the distributor rotor 5 has fins 24, 25 and 26 formed on the upper surface thereof and fins 28 formed on the lower surface thereof, the flow rate of the swirling air flow is increased so that the ventilation efficiency can be much more enhanced. Further, since the fins 24 and 25 serve also as a portion of the terminal portion 22 and the weight balancing portion 23, respectively, there is no need for the provision of special fins, thereby facilitating the production of the distributor rotor.

Since the discharge hole is formed in the cap at a position above the distributor rotor and the air intake is formed eight in the cap or in the housing at a position below the distributor rotor, upward air flow can be induced within the distributor. This prevents the acidic substance produced around the distributor rotor from moving downwardly within the distributor rotor. Furthermore, even if the acidic substance moves downwards within the distributor, it can be removed upwardly and discharged. Therefore, the acidic substance can be discharged quickly to the atmosphere and prevented from stagnating in the lower portion, etc., of the distributor. This results in improved durability of the internal component parts.

The auxiliary airflow guiding member is connected integrally with the airflow guiding member located near the corner of the cap and extends towards the center of rotation of the distributor rotor and along or in a substantially parallel direction with the rotational surface thereof. The auxiliary airflow guiding member is formed so as to project from the inner surface of the cap into the closed space. The air flow can be guided more effectively by the airflow guiding members. Further, since the area of the guiding member projecting into the passage for the swirling air flow in the vicinity of the discharge hole can be increased, the ventilation efficiency can be improved correspondingly, so that the acidic substance can be discharged quickly and prevented from stagnating in the lower part of the closed space.

The distributor rotor has also fins formed on the lower surface thereof, the amount of swirling air flow generated can be increased by the action of the fins formed on the upper and lower surface, thereby improving the ventilation efficiency further so that the acidic substance can be discharged quickly and prevented from stagnating in the distributor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A distributor for a vehicle comprising:

a housing;

a cap operatively positioned on said housing for defining a closed space therebetween;

a central electrode and a side electrode operatively mounted within said cap in a predetermined disposition;

a distributor rotor rotatably mounted relative to said housing and projecting within said closed space, said distributor rotor includes an upper end and a lower end;

at least one fin being mounted adjacent to said upper end of said distributor rotor for rotation together with said distributor rotor;

an air flow guiding member projecting into said closed space and formed at one side of said cap and an auxiliary air flow guiding member formed to extend from said air flow guiding member to a central portion of said cap for defining an air flow guide passage extending from said central portion to an inner surface of said cap for guiding the discharge of acidic material and air from said closed space;

an air intake aperture for introducing ambient air into the closed space; and a discharge aperture formed in said cap for discharging swirling air flow induced by rotation of the distributor rotor to travel from said air intake aperture along said air flow guiding member and through said discharge aperture to the atmosphere;

said discharge aperture is formed in said cap at a position above said distributor rotor and said air intake aperture is formed in said housing at a position in a lower portion thereof for enabling acidic material, generated by a spark produced by said rotation of said distributor rotator relative to said central electrode and said side electrode, and air to be discharged through said discharge aperture by said swirling air flow.

2. The distributor according to claim 1, wherein a plurality of fins are mounted adjacent to said upper end of said distributor rotor for assisting in the discharge of acidic material and air form said closed space.

3. The distributor according to claim 1, wherein fins are mounted adjacent to said upper and said lower ends of said distributor rotor.

* * * * *